United States Patent [19]

Yung

[11] Patent Number: 4,685,482

[45] Date of Patent: Aug. 11, 1987

[54] CLOSABLE, COLLAPSIBLE UMBRELLA FOR ONE-HAND OPERATION

[76] Inventor: Kwong Y. Yung, Flat 6, Block C, 3rd Floor, Chun Man Court, Ho Man Tin, Kowloon, Hong Kong

[21] Appl. No.: 708,702

[22] Filed: Mar. 6, 1985

[51] Int. Cl.[4] ..... A45B 25/14; A45B 19/04

[52] U.S. Cl. ..... 135/24; 135/20 M

[58] Field of Search ..... 135/20 M, 22, 23, 24, 135/20 R

[56] References Cited

U.S. PATENT DOCUMENTS

| | | | |
|---|---|---|---|
| 1,063,378 | 6/1913 | Olsson | 135/25 R |
| 1,107,835 | 8/1914 | Peterson | 135/25 R |
| 1,117,365 | 11/1914 | Frisk et al. | 135/25 R |
| 3,672,381 | 6/1972 | Kida et al. | 135/24 |
| 3,677,274 | 7/1972 | Yasuda et al. | 135/24 |
| 3,796,226 | 3/1974 | Yuen | 135/24 |
| 3,856,030 | 12/1974 | Sato | 135/24 X |
| 4,421,133 | 12/1983 | Huang | 135/24 X |

FOREIGN PATENT DOCUMENTS

| | | | |
|---|---|---|---|
| 2300153 | 1/1973 | Fed. Rep. of Germany | 135/25 R |
| 643719 | 6/1984 | Switzerland | 135/20 M |

*Primary Examiner*—Robert A. Hafer
*Assistant Examiner*—D. Neal Muir
*Attorney, Agent, or Firm*—Felfe & Lynch

[57] ABSTRACT

A folding umbrella having a telescopic stem which is connected to a crown at the top and at the bottom to a handle pivotally supporting a radius hand-grip, ribs and stretchers are provided for extending or collapsing the roof of the umbrella, a runner is slidable along the stem for actuating the ribs and stretchers through interposed links and auxiliary links, a lever is co-operative between the radius hand-grip and an elongated runner slide which is slidably arranged within the runner and around the stem and which carries at the upper end a notch member to which the struts, pivoted to the links or stretchers, are pivotally connected. The umbrella, while held in one hand, can be conveniently extended to convenient length, opened and closed by manipulating the radius hand-grip with the thumb and/or fingers in a direction transverse to the stem and also can be conveniently collapsed to reduce the length and retained in locked position by pushing the handle toward the crown while the top of the stem is supported or propped against any object.

6 Claims, 5 Drawing Figures

CLOSABLE, COLLAPSIBLE UMBRELLA FOR ONE-HAND OPERATION

The present invention relates to an umbrella and, more particularly, to a folding umbrella.

The present invention makes use of an operating principal described in my U.S. Pat. No. 3,796,226 which is incorporated herein by reference and should be referred to for further information.

A main object is to provide an umbrella which not only can be conveniently opened and closed but also can be conveniently extended to a convenient length for use, collapsed, and retained in the collapsed position by one hand.

Another object of the invention is to provide such a folding umbrella, i.e. suited for one hand control, constructed to be retained in the closed position held tip downward by a spring which has been energized when the umbrella is being opened. The spring force thus militates against ease of opening operation, and the force required for this is reduced by having the ribs, stretchers, links and auxiliary links for supporting the umbrella fabric are so arranged that they expand to open and contract to close instead of swinging as described in my U.S. Pat. No. 3,796,226. This is particularly advantageous for the umbrella of the invention which is opened by squeezing a radius hand-grip with the thumb while the other fingers are gripping the stem and the handle.

And another object of the invention is to provide an umbrella which is more easy to operate and economical to manufacture.

Embodiments of the invention are illustrated by way of example in the accompanying drawings, in which.

Figure 5:
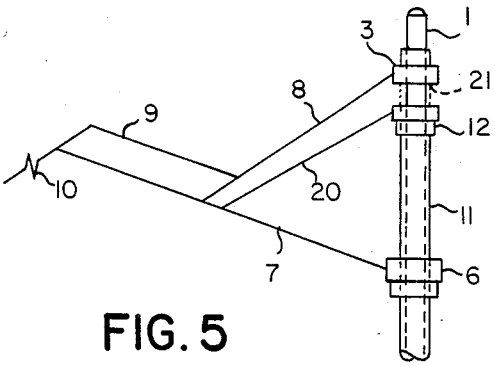
FIG. 5 shows a second embodiment of the struts, links and stretchers of the umbrella according to the invention in the open position.
Figure 1:
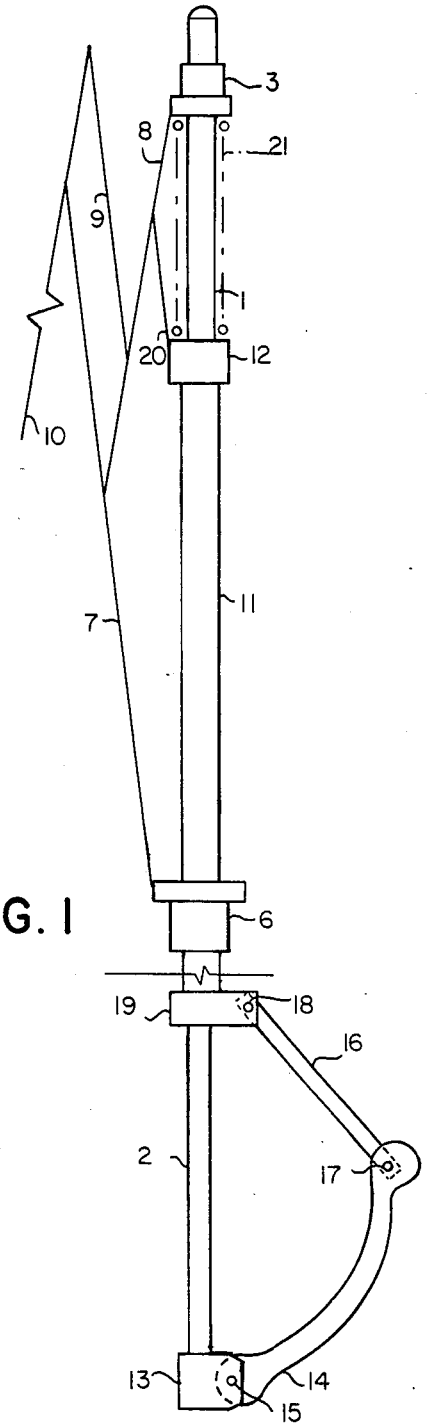
FIG. 1 shows one embodiment of umbrella in a closed, stem-expanded position.
Figures 2, 3:
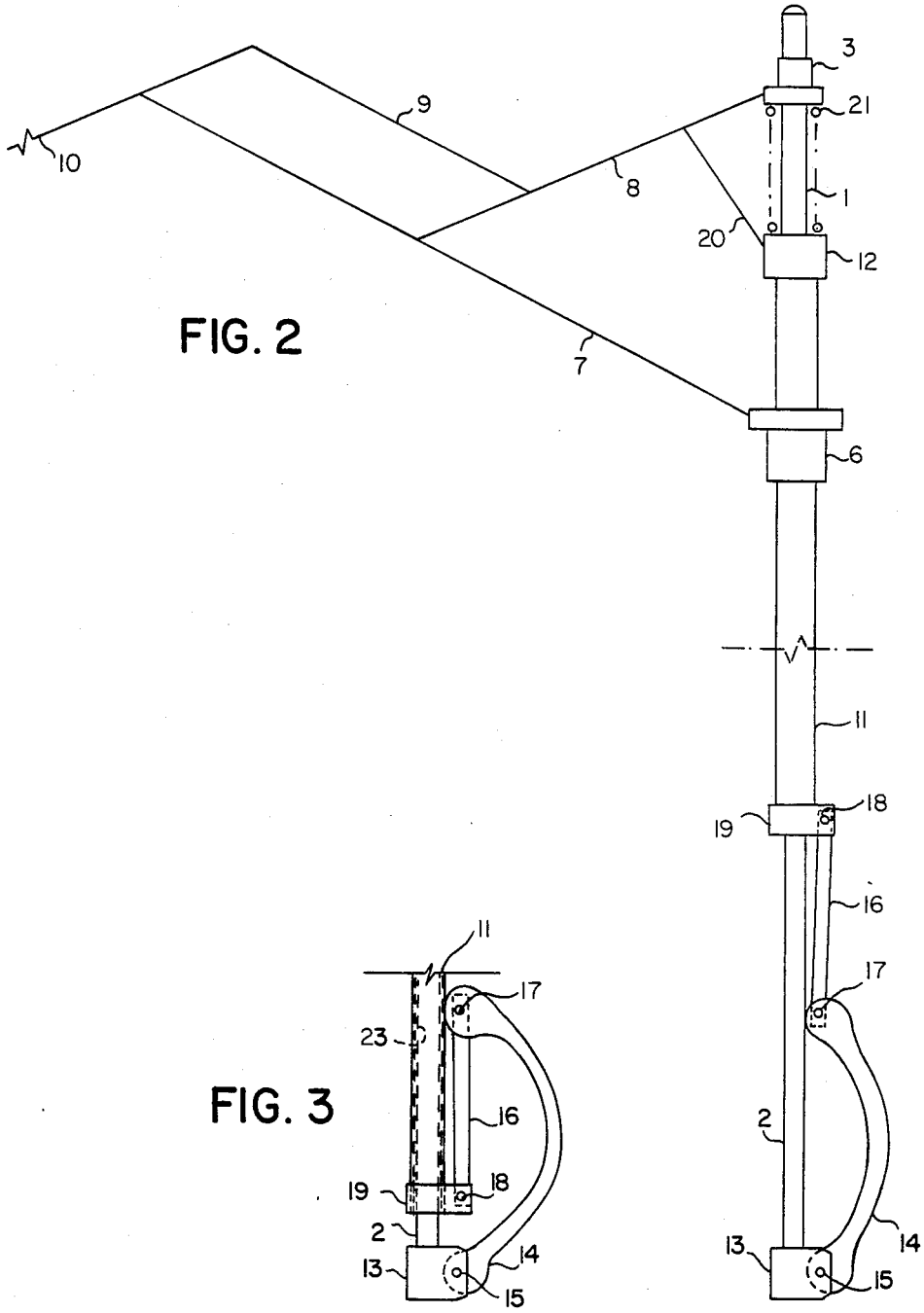
FIG. 2 shows the umbrella in an open stem-expanded position.
FIG. 3 is a partially cross sectioned side elevation showing the umbrella in locked position after the umbrella has been closed and the stem has been collapsed.
Figure 4:
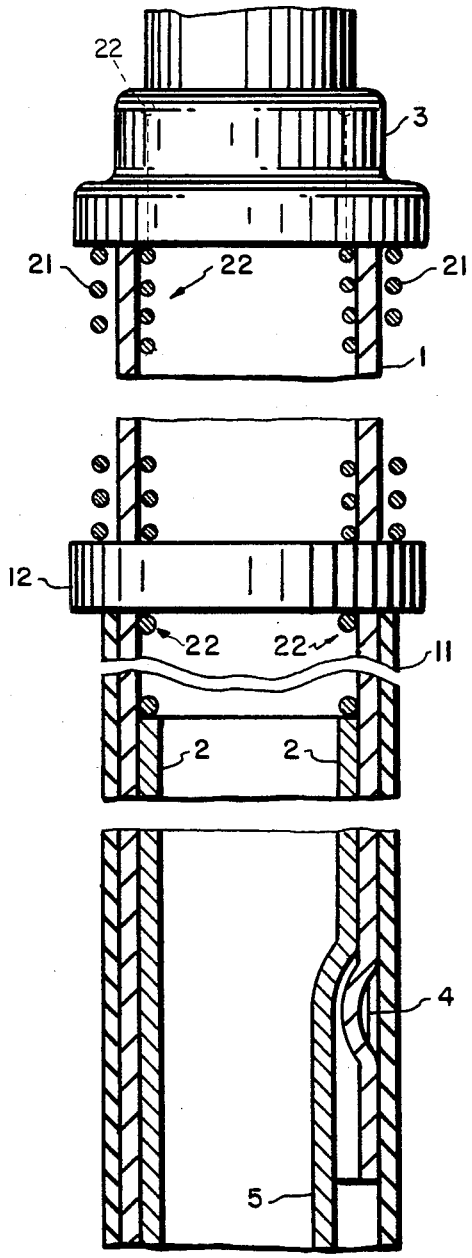
FIG. 4 is a cross sectional view of the normally concealed adjoining ends of the upper tube and lower tube of the umbrella stem illustrated in FIG. 2.

Referring to FIGS. 1 to 4, the umbrella there shown comprises a telescopic stem including an upper large diameter tube 1 and a lower smaller diameter tube 2, slidable within the upper large diameter tube 1. The upper tube 1 is connected to a crown 3 at its top end and at its lower end an inwardly flanged tip 4 is provided. The lower tube 2 is formed with a longitudinal groove 5 which extends from its bottom end to a position near its opposite upper end. The inwardly flanged tip 4 is adapted to engage with the groove 5 to prevent relative rotation between the upper tube 1 and the lower tube 2 and to limit the maximum extension of the umbrella stem in usual and conventional manner. A provided runner 6 is slidably attached along the stem and pivotally supports one end of a stretcher 7. Proximate ends of links 8 are pivotally supported by the crown 3 and the distal ends of links 8 are pivotally attached to the stretchers 7 at a position intermediate between the ends of the stretcher 7. Auxilliary links 9 are pivotally attached at one of their ends to the links 8 intermediate the link ends thereof and at their other ends to the inner ends of ribs 10. The outer ends of the stretchers 7 are pivotally attached to the ribs 10 outwardly of their inner ends. A tubular elongated runner slide 11 is slidably arranged within the runner 6 and around the stem and carries at its upper end a notch member 12 which moves between the crown 3 and the runner 6. The lower tube 2 carries at its bottom end a handle 13 to which a bow-like radius hand-grip 14 is pivoted at point 15. A lever 16 is pivoted by one of its ends at point 17 to the outer end of the radius handgrip 14 and at its other end to a collar 19, which is secured to the lower end of the tubular elongated runner slide 11. Struts 20 pivotally supported by the notch member 12 are pivotally attached to the links 8 for opening or closing the umbrella on movement of the elongated runner slide 11 which is displaced by the radius hand-grip 14 through the lever 16. A compression spring 21 is arranged between the crown 3 and the notch member 12 for closing the umbrella and retaining the umbrella in a closed position. A compression spring 22 is arranged inside the upper tube to retain the stem in an extended position. It is customary to make the telescopic stem and the elongated runner slide substantially different in diameter in order to provide ample clearance therebetween. A sleeve 23 is tightly fitted inside the tubular elongated slide in a desired position and secured thereto serving as a bushing slidably mounted on the lower smaller diameter tube 2. For operation, the umbrella is so arranged and constructed that the distance from the pivot point 18 to the axis of the stem is longer than the distance from the pivot point 15 to the axis of the stem and longer than the distance from the pivot point 17 to the axis of the stem when the umbrella is closed and the stem is shortened or collapsed. Thus the force produced by the compression spring 22 inside the upper tube 1 is diverted in order to retain the umbrella in locked position. For extending the umbrella to a convenient length the outer end of the radius hand-grip 14 is pulled away from the stem by the thumb and forefinger of the hand holding the umbrella while the handle 13 is supported in the palm of a user's hand. The stem of the umbrella will be extended by the force produced by the compression spring 22 inside the upper tube 1. To open the umbrella the hand holding the umbrella transfers to grip the umbrella with the thumb placed on the outer end of the radius hand-grip 14 while other fingers are holding the stem and the handle 13, the radius hand-grip 14 is squeezed until its outer end rests on the stem, since the distance from the pivot point 17 to the axis of the stem is shorter than the distance from the pivot point 18 to the axis of the stem and shorter than the distance from the pivot point 15 to the axis of the stem the force of the compression spring 21 is diverted to retain the umbrella in open position. To close the umbrella while the fingers are holding the stem and the handle, a flick of the thumb applied to the radius hand-grip 14 removes the outer end of the radius hand-grip 14 from the stem and the umbrella closes by the force of the compression spring 21. By pushing the handle toward the crown while the top of the crown 3 is supported or proped against any object, the stem of the umbrella is shortened and simultaneously the radius hand-grip 14 and the lever 16 are being collapsed upon each other, and when the umbrella has been fully collapsed the force of the compression spring 22 is diverted to retain the collapsed umbrella in locked position as previously described.

Referring to FIG. 5 the construction of the umbrella is the same as described in FIGS. 1 to 4 except that the struts 20 are pivoted to the stretchers 7 instead of to the links 8. The umbrella can be operated as previously described.

It will be understood that the specification and examples are illustrative but not limitative of the present invention and that other embodiments within the spirit and scope of the invention will suggest themselves to those skilled in the art.

I claim:

1. An umbrella being operated by one hand, comprising:

a telescopic stem including a large diameter tube (1) at one end of said stem and a smaller diameter tube (2) partly slidable within said large diameter tube (1) and having an end projecting from said large diameter tube (1) to the other end of said stem;

a crown (3) connected to one of said ends of said stem;

a handle (13) secured to the other of said ends of said stem;

a radius handgrip (14) pivoted at one end to said handle (13);

means comprising ribs (10), stretchers (7), links (8) and auxiliary links (9) pivotally interconnected for constituting a frame carried on said stem;

an elongated runner slide (11) slidable on said stem;

a runner (6) slidable along said elongated runner slide (11) and pivotally supporting one end of each of said stretchers (7), said links (8) each being pivoted at one end to said crown (3) and at the other end to said stretchers (7) intermediate the ends of said stretchers (7), each of said auxiliary links (9) being pivoted at one end to one of said links (8) intermediate the ends of said links (8) and at the other end to one end of said ribs (10), the other ends of said stretchers (7) being pivoted to said ribs (10) intermediate the ends of said ribs (10);

a collar (19) at one end of said elongated runner slide (11);

a notch member (12) on the other end of said elongated runner slide (11), said other end of said elongated runner slide being closer to said crown (3) than said collar, whereby said notch member (12) is movable between said crown (3) and said runner (6) from a first position to a second position, said second position being closer to said crown upon the opening of the umbrella;

struts (20) each pivoted at one end to said notch member (12) and at their other end to a selective one of said links (8) and said stretchers (7) intermediate the ends thereof; and a lever (16) pivotally attached at one end to said collar (19) and at the other end to the other end of said radius handgrip, whereby arcuate movement of the radius handgrip (14) transversely of the axis of said stem actuated by the user permits expanding or collapsing said stem and, by relative axial sliding movement of said elongated runner slide, said runner, and said notch along said stem to displace said struts (20), opening or closing said frame, said sliding movement resulting from a movement of said lever through a perpendicular relative to a longitudinal axis of said stem.

2. An umbrella as claimed in claim 1, and further comprising a compression spring arranged between said crown and said notch member for closing the umbrella

3. An umbrella as claimed in claim 1 wherein said elongated runner slide is a tube about said stem and further comprising a sleeve tight fit inside said elongated runner slide for serving as a bushing slidable along said smaller diameter tube.

4. An umbrella as claimed in claim 1 wherein said other end of each of said struts is pivoted to said stretchers.

5. An umbrella as claimed in claim 1, and further comprising:

a compression spring is arranged inside said large diameter tube.

6. An umbrella being operated by one hand, comprising:

a telescopic stem including a large diameter tube (1) at one end of said stem and a smaller diameter tube (2) partly slidable within said large diameter tube (1) and having an end projecting from said large diameter tube (1) to the other end of said stem;

a spring means for biasing said small diameter tube from said larger diameter tube toward said projection with means to limit axial movement;

a crown (3) connected to one of said ends of said stem;

a handle (13) secured to the other of said ends of said stem;

a radius handgrip (14) pivoted at one end to said handle (13);

means comprising ribs (10), stretchers (7), links (8) and auxiliary links (9) pivotally interconnected for constituting a frame carried on said stem;

an elongated runner slide (11) slidable on said stem;

a runner (6) slidable along said elongated runner slide (110 and pivotally supporting one end of each of said stretchers (7), said links (8) each being pivoted at one end to said crown (3) and at the other end to said stretchers (7) intermediate the ends of said stretchers (7), each of said auxiliary links (9) being pivoted at one end to one of said links (8) intermediate the ends of said links (8) and at the other end to one end of said ribs (10), the other ends of said stretchers (7) being pivoted to said ribs (10) intermediate the ends of said ribs (10);

a collar (19) at one end of said elongated runner slide (11);

a notch member (12) on the other end of said elongated runner slide (11), said other end of said elongated runner slide (11) being closer to said crown (3) than said one end thereof, whereby said notch member (12) is movable between said crown (3) and said runner (6) from a first position to a second position, said second position being closer to said crown upon the opening of the umbrella;

a second spring means for biasing said crown from said notch member;

struts (20) each pivoted at one end to said notch member (12) and at their other end to a selective one of said links (8) and said stretchers (7) intermediate the ends thereof; and a lever (16) pivotally attached at first end to said collar (19) and at a second end to the other end of said radius handgrip (14), whereby arcuate movement of the radius handgrip (14) transversely of the axis of said stem actuated by the user permits expanding and collapsing said stem and, by relative axial sliding movement of said elongated runner slide, said runner, and said notch along said stem to displace said struts (20), opening and closing said frame, said sliding movement resulting from a movement of said lever through a perpendicular to a longitudinal axis of said stem.

* * * * *